US008576246B2

(12) United States Patent
Dumarest

(10) Patent No.: US 8,576,246 B2
(45) Date of Patent: Nov. 5, 2013

(54) IMAGE PROCESSING METHOD AND DEVICE

(75) Inventor: Jacques Dumarest, Notre Dame de Mesage (FR)

(73) Assignee: ST-Ericsson SA, Plan-les-Ouates (CH)

( * ) Notice: Subject to any disclaimer, the term of this patent is extended or adjusted under 35 U.S.C. 154(b) by 2166 days.

(21) Appl. No.: 11/352,893

(22) Filed: Feb. 13, 2006

(65) Prior Publication Data

US 2006/0181724 A1 Aug. 17, 2006

(30) Foreign Application Priority Data

Feb. 14, 2005 (FR) ..... 05 01469

(51) Int. Cl.
*G09G 5/00* (2006.01)
*G09G 5/02* (2006.01)

(52) U.S. Cl.
USPC ..... 345/605; 345/581; 345/600

(58) Field of Classification Search
USPC ..... 345/600, 605, 581
See application file for complete search history.

(56) References Cited

U.S. PATENT DOCUMENTS

| | | | | |
|---|---|---|---|---|
| 5,081,450 | A * | 1/1992 | Lucas et al. | 345/615 |
| 5,469,190 | A * | 11/1995 | Masterson | 345/605 |
| 5,604,514 | A * | 2/1997 | Hancock | 345/604 |
| 6,064,367 | A * | 5/2000 | Horioka | 345/605 |
| 6,272,257 | B1 * | 8/2001 | Prokop | 382/246 |
| 7,068,285 | B2 * | 6/2006 | Lee | 345/605 |
| 7,227,524 | B2 * | 6/2007 | Ueno et al. | 345/89 |
| 2002/0109702 | A1 | 8/2002 | Kobayashi | 345/600 |
| 2003/0169244 | A1 | 9/2003 | Kurokawa et al. | 345/204 |
| 2003/0231195 | A1 | 12/2003 | Ueno et al. | 345/698 |
| 2005/0093819 | A1 * | 5/2005 | Wang | 345/156 |

FOREIGN PATENT DOCUMENTS

| | | | |
|---|---|---|---|
| EP | 1363267 | 11/2003 | G09G 5/04 |

* cited by examiner

*Primary Examiner* — M Good Johnson
(74) *Attorney, Agent, or Firm* — Coats & Bennett, P.L.L.C.

(57) ABSTRACT

This image processing method for the conversion of an image with a first number of bits per pixel, for example 16 bits per pixel, into an image with a second number of bits per pixel, for example 18 bits per pixel, includes generating additional coding bit values for the components ($R_i$, $G_i$, $B_i$) of each pixel starting from the component values of adjacent pixels and generating the converted signal from the additional coding bits.

22 Claims, 6 Drawing Sheets

| @ | 31...27 | 26...21 | 20...16 | 15...11 | 10...5 | 4...0 |
|---|---|---|---|---|---|---|
| 0 | R n+1 | G n+1 | B n+1 | R n | G n | B n |
| 4 | R n+3 | G n+3 | B n+3 | R n+2 | G n+2 | B n+2 |

FIG. 1
(PRIOR ART)

| @ | 31...24 | 23...16 | 15...8 | 7...0 |
|---|---|---|---|---|
| 0 | B n+1 | R n | G n | B n |
| 4 | G n+2 | B n+2 | R n+1 | G n+1 |
| 8 | R n+3 | G n+3 | B n+3 | R n+2 |

FIG. 2
(PRIOR ART)

| | | |
|---|---|---|
| $R_{i-1,j-1} - G_{i-1,j-1}$ | $R_{i-1,j} - G_{i-1,j}$ | $R_{i-1,j+1} - G_{i-1,j+1}$ |
| $R_{i,j-1} - G_{i,j-1}$ | $R_{i,j} - G_{i,j}$ | $R_{i,j+1} - G_{i,j+1}$ |
| $R_{i+1,j-1} - G_{i+1,j-1}$ | $R_{i+1,j} - G_{i+1,j}$ | $R_{i+1,j+1} - G_{i+1,j+1}$ |

| | 24 bpp FRAME MEMORY | 16 bpp FRAMEMEMORY RED lsb = BLUE lsb = 0 | | CONVERSION 16 bpp 18 bpp |
|---|---|---|---|---|
| | | TRUNCATION | ROUNDING | |
| PSNR RED | 42.69 dB | 35.70 dB | 40.72 dB | 42.00 dB |
| PSNR GREEN | 42.69 dB | 42.69 dB | 46.37 dB | 46.37 dB |
| PSNR BLUE | 42.69 dB | 35.70 dB | 40.72 dB | 42.00 dB |
| PSNR LUMA | 42.69 dB | 38.45 dB | 43.14 dB | 44.00 dB |
| SIZE T OF THE MEMORY FRAME | T x 1.5 | T | T | T |

IMAGE PROCESSING METHOD AND DEVICE

FIELD OF THE INVENTION

The invention relates to the display or printing of high quality images, and notably the display of images in 'true color' mode, in particular for liquid crystal LCD devices.

BACKGROUND OF THE INVENTION

A particularly useful application of the invention relates to the display of images on LCD screens of cellular telephones or personal assistants (PDA) which are currently beginning to allow high quality images to be displayed, in other words screens that are capable of simultaneously displaying 262,144 colors.

As is well known, most of the colors to be displayed can be reproduced starting from three primary colors, namely red, green and blue (RGB). Likewise, the pixels, forming the images to be displayed on the screens or to be printed, are each associated with values of red, green and blue components. These component values are coded, for each pixel, in the form of a frame of bits whose width defines the maximum number of colors for the displayed image.

In this way, a 16-bit frame allows 65,536 colors to be displayed and an 18-bit frame allows 262,144 colors to be displayed, while a 24-bit frame allows 16 million colors to be simultaneously displayed.

Currently, liquid crystal LCD screens used in portable devices such as cellular telephones or PDAs only allow 262,144 colors to be displayed, which corresponds to an 18-bit frame. Such a frame comprises 6 bits for coding the red component, 6 bits for coding the green component and 6 bits for coding the blue component.

Thus, for optimal operation, the images delivered to a display with a capacity of 262,144 colors are coded by a frame with 18 bits per pixel. The problem is that the image processing algorithms and the hardware devices, in particular the frame memories, do not generally allow such a format to be supported.

In fact, frame memories that are used to store the images before they are displayed on a screen, are generally only designed for storing frames with 16 bits, 24 bits or 32 bits per pixel, i.e. a multiple of 8 bits (Byte).

In FIGS. 1 and 2, the layout of such a frame memory organized in 32-bit words for the storage of a frame with 16 bits per pixel and for the storage of a frame with 24 bits per pixel, respectively, is shown. As can be seen in FIG. 1, in a format with 16 bits per pixel, the blue and red components are coded by 5-bits, whereas 6 bits are used for the coding of the green component. Each memory address allows the values of red, green and blue components of 2 pixels (n, n+1) of an image to be stored.

As far as the storage of a frame with 24 bits per pixel is concerned, 8 bits are used for coding the red, green and blue components. Four pixels are stored in three memory words. Since the bits of four pixels can be stored in three 32-bit memory addresses ($4\times24=3\times32$), the result of this is that one pixel could end up spanning two memory words (pixels n+1 and n+2) such that, if it is desired to modify one pixel, two words need to be processed leading to a much longer processing time and a much higher bandwidth.

With reference to FIG. 3, when a frame memory with 24 bits per pixel is employed, an optimal quality for the displayed image is obtained. However, since a liquid crystal display of a portable device only generally supports a maximum of 18 bits per pixel, the two least significant bits of the coding words of the color components are not connected to the display (truncation of the exact value).

This approach allows 262,144 colors to be displayed, but at the cost of an increase in the size of the memory of 50% with respect to a frame memory with 16 bits per pixel. In addition, the required bandwidth is also increased by 50%. With regard to the quality of the images obtained, the PSNR (Peak Signal-to-Noise Ratio) ratio is 42.69 decibels for each 8-bit color component truncated to 6 bits. This ratio is conventionally calculated from a calculation of the mean square error MSE between reference pixel values and pixel values resulting from the truncation.

Referring now to FIG. 4, in which the use of a frame memory with 16 bits per pixel for displaying images on an LCD display with 18 bits per pixel is shown, it can be seen that, in this case, the red and blue 5-bit coding words and the coding word for the green component, with a 6-bit coding, are transmitted in their entirety into the corresponding inputs of the LCD display. However, in this case, the least significant bits (LSBs) of the red and blue components of the frame memory are not connected. In the exemplary embodiment shown, the LSB bits of the red and blue components are set at zero. The stored coding words for the red and blue components may however be respectively generated either by truncation, or by calculation of a rounded value starting from the 24-bit value.

As has been indicated previously, the truncation includes ignoring the least significant bits of the coding words for the red and blue components. In this case, the PSNR ratio for the red and blue components is 35.70 decibels and the PSNR ratio for the green component is 42.69 decibels. With regard to the calculation of the rounded value, this exhibits a PSNR ratio of 40.72 decibels with respect to the red and blue components and a PSNR ratio of 46.37 decibels with respect to the green component.

SUMMARY OF THE INVENTION

In view of the above, an object of the invention is to overcome the drawbacks of the display systems of the prior art and, generally speaking, to allow a high quality image to be displayed, in particular an image with 262,144 colors, using a frame memory of reduced capacity.

More particularly, another aim of the invention is to allow an image with 262,144 colors to be displayed starting from an image with 16 bits per pixel output from a frame memory.

According to a first aspect, a subject of the invention is therefore an image processing method for the conversion of a signal with a first number of bits per pixel into a signal with a second number of bits per pixel, greater than the first number of bits per pixel, the signal to be converted and the converted signal comprising a set of pixels each associated with red, green and blue component values forming a frame with the first number of bits and a frame with the second number of bits, respectively. According to this method, additional bit values for coding the components of each pixel are generated starting from the component values of adjacent pixels, the additional coding bits being used for the generation of the converted signal.

According to another feature, the signal to be converted and the converted signal respectively comprise a set of pixels associated with red, green and blue component values forming a frame with 16 bits per pixel and a frame with 18 bits per pixel.

In one embodiment, the image to be converted may include a matrix of rows and columns of pixels, the values of the additional bits are generated by considering the pixels from an analysis window of 3×3 pixels. As a variant, the values of the additional bits are generated by considering the pixels from an analysis window of 5×5 pixels. Analysis windows with any given number of pixels, preferably an odd number of pixels, encompassing the pixel to be processed could also be used.

For the generation of the converted signal, the values of the coding bits of the green component of the image to be converted is assigned to the coding bits of the green component of the converted image, since the green component is already coded over 6 bits. In contrast, the values of the coding bits of the red component and of the blue component are determined by calculation, for each of the red and blue components, of the difference between the values of the red and green components, on the one hand, and of the difference between the values of the blue and green components, on the other, by calculation of a filtered value from the calculated difference values and by assigning one additional bit to the values of the red and blue components of the image to be converted as a function of the filtered value.

The filtering is effected by applying weighting coefficients to the calculated difference values. Furthermore, the weighted values are added and the result of the addition is divided by the sum of the weighting coefficients from the analysis window.

Thus, in the case where the difference between the filtered value of the red component, on the one hand, and of the blue component, on the other, and the non-filtered values of the components, respectively, is greater than 2, the additional bit is set at 1. Conversely, in the case where the difference is less than or equal to −2, the additional bit is obtained by subtracting the bit 1 at the location of the additional bit. Otherwise, in other words if the value of the difference is less than or equal to 2 or greater than −2, the value of the red component or of the blue component of the image to be converted is assigned to the value of the red component or of the blue component of the converted image (value unchanged).

According to another mode of implementation, the value of a pixel undergoing processing and of adjacent pixels is compared with a threshold value and a maximum value is assigned to the pixel undergoing processing if this pixel and the adjacent pixels all have a value greater than the threshold value.

According to a second aspect, another subject is an image processing device for the conversion of a signal with a first number of bits per pixel into a signal with a second number of bits per pixel, greater than the first number of bits per pixel, the signal to be converted and the converted signal comprising a set of pixels each associated with red, green and blue component values forming a frame with the first number of pixels and a frame with the second number of pixels, respectively, characterized in that it comprises means or a circuit for generating additional bit values for coding the components of each pixel starting from the component values of adjacent pixels, and means or a circuit for generating the converted signal starting from the coding bits for the values of the red, green and blue components of the signal to be converted and from the additional coding bits.

A further subject is a flat panel screen, comprising a set of pixels driven by one or more peripheral control circuits converting a signal with a first number of bits per pixel into a signal with a second number of bits per pixel, greater than the first number of bits per pixel, the signal to be converted and the converted signal comprising a set of pixels each associated with red, green and blue component values forming a frame with the first number of bits and a frame with the second number of bits, respectively, characterized in that it comprises means or a circuit for generating additional bit values for coding the components of each pixel starting from the component values of adjacent pixels, and means or a circuit for generating the converted signal starting from the coding bits for the values of the red, green and blue components of the signal to be converted and from the additional bits. According to a particular embodiment, the flat panel screen can be an LCD, TFT, OLED or CRT screen According to yet another aspect, another subject is a portable electronic device, of the mobile telephone type, characterized in that it comprises a flat panel screen such as is defined herein above. By electronic device, in the framework of the present description, is understood any type of portable or mobile terminal or handset such as a mobile telephone, a PDA, a digital camera or any other type of device of this type equipped with a flat panel screen.

BRIEF DESCRIPTION OF THE DRAWINGS

Other objects, features and advantages of the invention will become apparent upon reading the following description, presented solely by way of non-limiting example and with reference to the appended drawings, in which:

FIGS. 1 and 2, which have already been mentioned, illustrate the architecture of a frame memory with 16 bits per pixel and of a frame memory with 24 bits per pixel, respectively, as in the prior art;

DETAILED DESCRIPTION OF THE PREFERRED EMBODIMENTS

Figure 3:
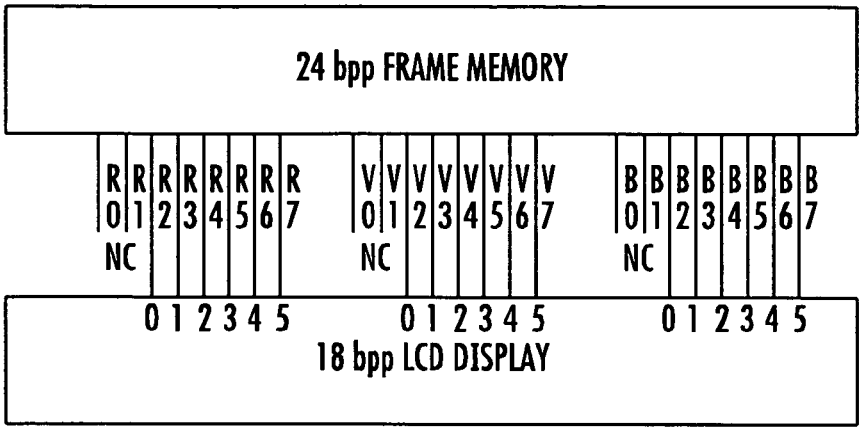
FIG. 3 and FIG. 4, mentioned previously, respectively illustrate the display of an image with 18 bits per pixel on an LCD display starting from a frame memory with 24 bits per pixel and from a frame memory with 16 bits per pixel, respectively, as in the prior art.
Figure 4:
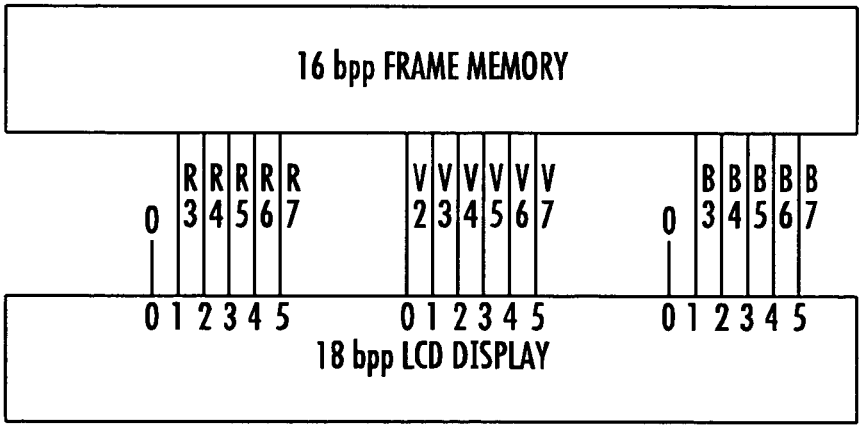

In the following part of the description, an exemplary embodiment of an image processing method according to the invention is described. In the exemplary embodiment considered, this method is designed to allow a high quality image with 262,144 colors to be displayed on an LCD display device with 18 bits per pixel (18 bpp) while only using a frame memory with 16 bits per pixel (16 bpp), and while preserving the required bandwidth.

However, the principle according to the invention could equally be generalized to the conversion of other data formats. Similarly, the invention can just as easily be applied to image processing for the display of the image on a screen as to the printing of this image.

As previously indicated, in the application envisaged, the image includes a set of pixels each being associated with red, green and blue component values coded, for each pixel, by a 16-bit frame, namely 6 bits for the green, 5 bits for the red and 5 bits for the blue. On the other hand, to display 262,144 colors, the pixels are each associated with red, green and blue component values forming a frame with 18 bits, namely 6 bits for the green, the red and the blue. Therefore, according to the method, the 16 bpp image will need to be converted into an 18 bpp image.

It should also be recalled that the incident image originates from a sensor of the CCD or CMOS type equipped with a color filter known as a 'Bayer filter'. This image acquisition technology is widespread and will therefore not be described in detail below.

It will however be noted that, according to this technique, the image acquisition is performed by filters of three colors, namely red, green and blue, placed according to a two-dimensional array such that each pixel detected corresponds to the color of the filter for that pixel. The filters are configured such that 50% of the filters are green, that 25% of the filters are red and that 25% of the filters are blue.

Thus, in the mosaic obtained, half of the pixels are green, a quarter of the pixels are red and a quarter of the pixels are blue, which corresponds to the maximum sensitivity for the human eye. For each pixel, the components of the missing colors will then need to be recovered. This is generally carried out by way of conventional interpolation methods, by using the values of the corresponding components from the adjacent pixels.

As is known, according to this technique, a spatial correlation exists between the red and blue components but also a correlation between the red and blue components and the green component.

In the case where the image source is not a CMOS or CCD sensor, but a compressed image in the JPEG or MPEG standard, the original format is usually coded in luminance and blue and red chrominance information: Y, Cb, Cr with an under-sampling of the chrominances of the 4:2:2 or 4:2:0 type which signifies that the chrominance information is a half or a quarter with respect to the luminance. Furthermore, in the 16 bpp format, given that 6 bits are used for the coding of the green component, whereas 5 bits are used for the coding of each of the red and blue components, the definition as regards the green component is higher.

In view of the above, the conversion method according to the invention uses the spatial correlation that exists between the red and blue components and the correlation that exists between the red and blue components, on the one hand, and the green component, on the other, and is also based on the higher definition of the green component.

As previously indicated, an 18 bpp frame needs to be generated, in other words a frame according to which the red, green and blue components are each coded by a 6-bit word, starting from a 16 bpp frame coming from the frame memory in which, for each pixel, the red and blue components are each coded using a 5-bit word, while the green component is coded by a 6-bit word.

Also, with regard to the green component, the 6-bit word of the green component of each pixel to be converted is copied into a corresponding coding word of the green component of each converted pixel.

As far as the red and blue components are concerned, for each pixel, an additional bit needs to be generated which is added to the 5 coding bits of the red and blue components of each pixel of the signal to be converted. The generation of these additional bits is based on the correlation existing between the red, green and blue components. Also, referring to FIG. 5, an analysis window is used which takes the pixels neighboring a pixel P being processed into account. As can be seen in this FIG. 5, the pixel pattern takes the form of a matrix of line i and column j of pixels each associated with red, green and blue RGB components. To generate the bits missing from the red and blue components of a pixel P being analyzed, the pixels immediately neighboring the pixel P are taken into account.

Figure 5:
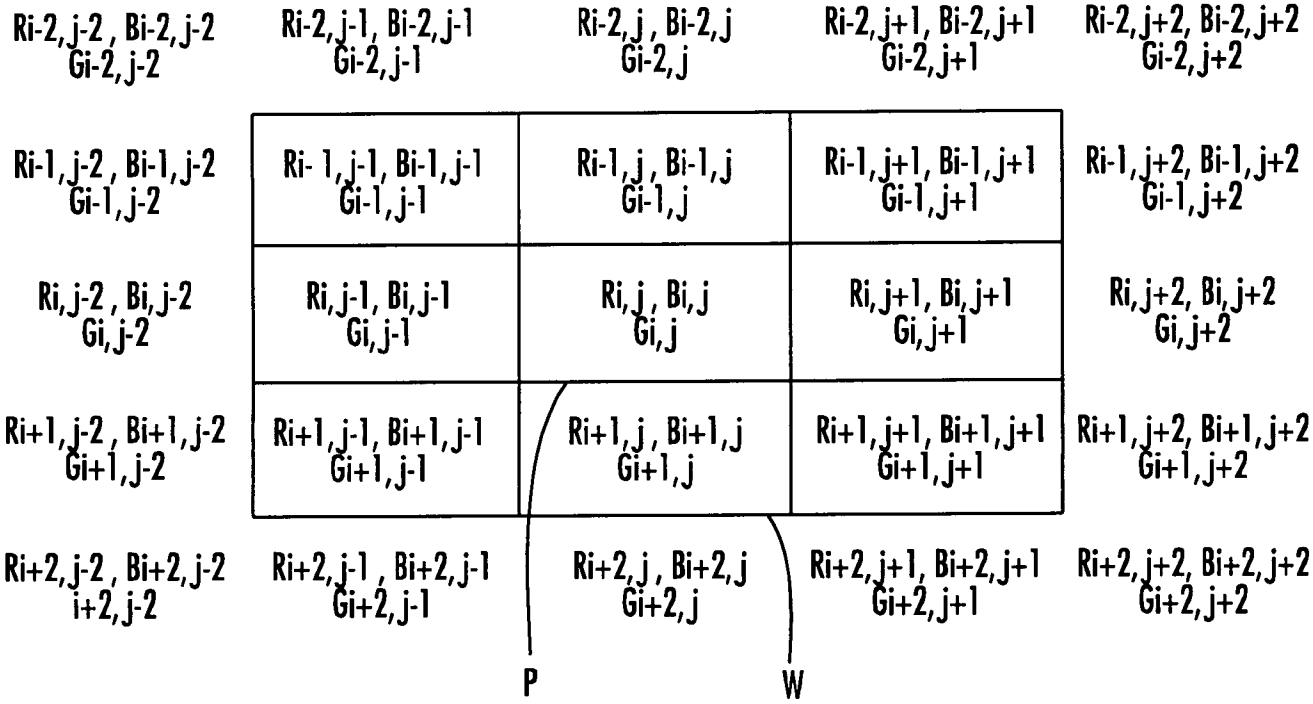
FIG. 5 is a diagram illustrating the conversion principle according to the invention.
Figure 6:
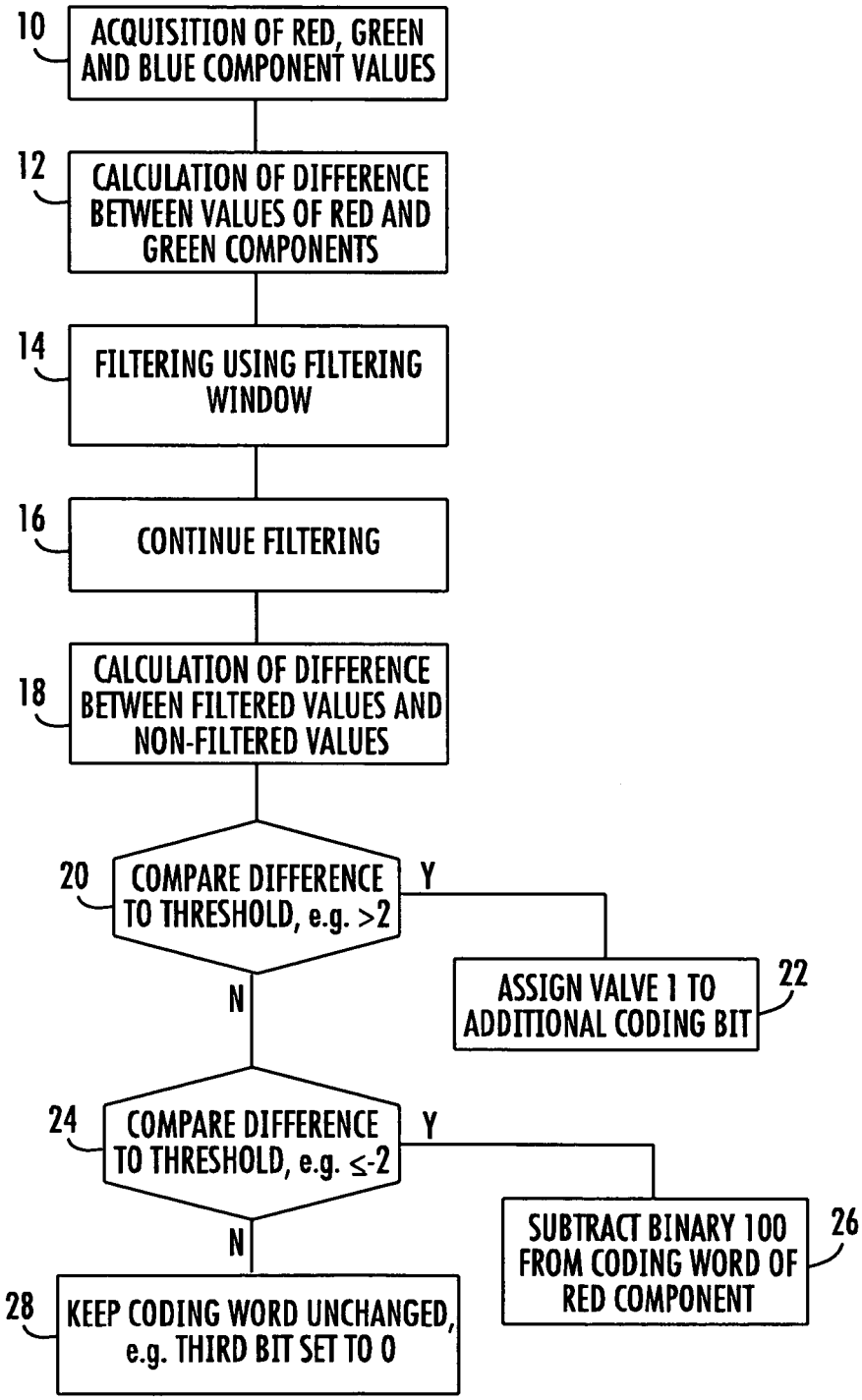
FIG. 6 is a flow diagram illustrating the main phases in an image processing method according to the invention.

In the exemplary embodiment shown in FIG. 5, the analysis window is a window of 3×3 pixels. However, as a variant, a window with five pixels could be used or any other window, with an odd number of pixels, of dimensions appropriate to the application envisaged. Thus, with reference to FIG. 6, during a first step 10, the acquisition of the red, green and blue component values for the set of the 9 pixels of the analysis window W is carried out.

Figures 7, 8:
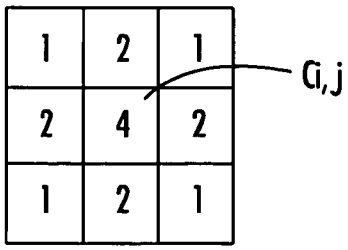
FIGS. 7 and 8 are other diagrams illustrating the conversion principle implemented by the image processing method according to the invention.

Referring also to FIG. 7, in which only the pixels detected by the analysis window W have been considered, and which corresponds to a processing step corresponding to the generation of one bit of a word for coding the red component, during the following step 12, a calculation of the difference between the values of the red and green components Rij−Gij is carried out for each of the 9 values of the analysis window of three by three pixels.

The difference values thus calculated are, during the following step 14, filtered by using the filtering window shown in FIG. 8. This filtering includes multiplying each difference value calculated during the preceding step 12 by a weighting coefficient $C_{ij}$ that depends on the position of the pixel considered, by assigning a maximum weighting coefficient, for example equal to 4, to the difference between the red and green components of the pixel P being analyzed.

During the following step 16, the filtering phase is continued by adding up the filtered values thus obtained and by dividing the result of the addition by the sum of the weighting coefficients from the window. During the following step 18, a calculation of the difference between the filtered value thus obtained and the non-filtered values is carried out.

Here, this involves subtracting the value of the difference between the red and green components of the pixel P being analyzed from the value of the filtered difference generated, as previously indicated, by using the component values of the neighboring pixels.

During the following steps 20 and 22, the result of the comparison thus performed is compared with predetermined threshold values. For example, in the exemplary embodiment considered, if the calculated difference between the filtered and non-filtered values is greater than 2, then the value 1 is assigned to the additional coding bit (step 22).

In other words, by considering that the five coding bits of the red component of each pixel to be converted are composed of the five most significant bits of a coding byte xxxxx000 of this red component (the x symbols denoting usable values of the coding word) during step 22, the binary value 100 is added to this word. The following converted coding word is therefore obtained: xxxxx100.

Conversely, if during the preceding step 20 it has been detected that the difference between the filtered value and the non-filtered value is less than or equal to two, during the following step 24, it is detected whether this difference is less than or equal to −2. If such is the case, during the following step 26, the binary value 100 is subtracted from the coding word of the red component. The following coding word in then obtained: yyyyy100.

Lastly, in the opposite case, where the difference between the filtered value and the non-filtered value is greater than −2, then the coding word is kept unchanged. In other words, the third bit is set at 0. The coding word of the red component of the converted pixel is then: xxxxx000.

The processing operation described herein above is performed in a similar manner for the blue component. In other words, following acquisition of the values of the red, blue and green components of each pixel (step 10), the difference between the blue and green components is calculated for each of the nine values of the window of three by three pixels. The difference thus calculated is then filtered, as previously mentioned. The filtered value is then compared with the threshold values previously indicated in order to either add or subtract the binary word 100, depending on the state of the additional coding bit, or to keep the third bit of the coding word of the blue component unchanged.

The algorithm used in the application of the conversion process described herein above from a 16 bpp image into an 18 bpp image may, for example, be carried out by using the following lines of code:

```
for (i=0 ; i<Height ; i++)
{
    if ((i !=0 && (i !=Height−1)))
        for j=0 ; j<Width*3 ; j=j+3)
        {
          if ((j !=0 && (j !=Width*3−3)))
          {
// Red Processing
// Compute Delta between Red and Green Value for the 9
pixels
Delta[0]=Buffer1[((i−1)*Width*3)+j−3]−Buffer1[((i−
1)*Width*3)+j−2]
Delta[1]=Buffer1[((i−1)*Width*3)+j]−Buffer1[((i−
1)*Width*3)+j−1]
Delta[2]=Buffer1[((i−1)*Width*3)+j+3]−Buffer1[((i−
1)*Width*3)+j+4]
Delta[3]=Buffer1[(i*Width*3)+j−3]−Buffer1[(i*Width*3)+j−
2]
Delta[4]=Buffer1[(i*Width*3)+j]−Buffer1[(i*Width*3)+j+1]
Delta[5]=Buffer1[(i*Width*3)+j+3]−
Buffer1[(i*Width*3)+j+4]
Delta[6]=Buffer1[((i+1)*Width*3)+j−3]−
Buffer1[((i+1)*Width*3)+j−2]
Delta[7]=Buffer1[((i+1)*Width*3)+j]−
Buffer1[((i+1)*Width*3)+j+1]
Delta[8]=Buffer1[((i+1)*Width*3)+j+3]−
Buffer1[((i+1)*Width*3)+j+4]
Filtered__Delta=(Delta[0]+2*Delta[1]+Delta[2]+2*Delta[3]+4
*Delta[4]+2*Delta [5]+Delta[6]+2*Delta[7]+Delta[8]/16
Current__Red=Buffer1[(i*Width*3)+j]
Current__Green=Buffer1[(i*Width*3)+j+1]
if ((Filtered__Delta−Delta[4]>2)
  Current__Red=Current__Red+4
Else if ((Filtered__Delta−Delta[4])<=−2)
{
  If (Current__Red !=0)
      Current__Red=Current__Red−4
}
      Bufffer2[(i*Width*3)+j=Current__Red
}
else
{
      Buffer2[(i*Width*3)+j= Buffer1[(i*Width*3)+j]
    }
  }
}
else
{
  for(j=0 ; j<Width*3 ; j=j+3)
  {
      Buffer2[(i*Width*3)+j= Buffer1[(i*Width*3)+j]
      Buffer2[(i*Width*3)+j+1]=
Buffer1[(i*Width*3)+j+1]
      Buffer2[(i*Width*3)+j+2]=
Buffer1[(i*Width*3)+j+2]
      }
  }
}
```

It should be noted that this algorithm is only a non-optimized examplary implementation that allows the processing operations performed to be illustrated. It only describes the processing operation effected on the red component, the processing operation for the blue component being identical. The red, green and blue values are coded over bytes: 8 bits.

Figures 9, 10:
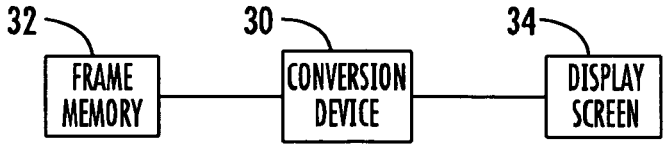
FIG. 9 is a comparison table illustrating the advantages gained by the conversion method according to the invention in the image obtained.
FIG. 10 shows an exemplary embodiment of an image processing device implementing the conversion method according to the invention.

With reference to FIG. 9, in which various values of PSNR ratio are shown, as regards notably the red, green and blue components and the size T of the frame memory for a frame memory with 24 bits per pixel and two LSB bits not connected; for a frame memory of 16 bits per pixel generated from the original 24 bpp value by truncation or rounding, and for a 16 bpp memory generated from the original 24 bpp value by rounding then displayed at 18 bpp by using a conversion according to the invention, it can be seen that the conversion allows an average gain of two decibels with respect to the use of a frame memory with 24 bits per pixel and a gain of 1 or of 5 decibels with respect to the use of a frame memory with 16 bits per pixel.

In FIG. 9, it will be noted that the PSNR values are the calculated values, except for the last column, which are the result of measurements of the quality of the algorithm presented herein above and which depend on the contents of the image.

Finally, referring now to FIG. 10, it will be noted that the conversion method may be incorporated in a device 30 that, for example, takes the form of an interface interposed between a frame memory 32 with 16 bits per pixel and an LCD display screen 34 with 18 bits per pixel for displaying images with 262,144 colors.

The interface then comprises software and hardware calculation means duly programmed to generate values of additional coding bits, and to generate the converted image from the additional bits, according to the method described previously. Of courses the invention is not limited to the embodiment described.

In the description of the embodiment of the invention just given, a further coding bit is added, in a frame of coding bits of each blue and red component, by setting an additional bit of the frame to "1" or "0" or, as indicated previously, while keeping the value of the red or blue component of an image to be converted unchanged.

The value of the further coding bit is determined as a function of the adjacent pixels, in relation to a pixel considered and, in particular, by calculating the difference between the red and green components, on the one hand, and of the blue and green components, on the other hand, and by calculating a weighted mean value over a set of adjacent pixels and computing the additional bit as a function of the weighted mean value.

To ensure that the whole set of colors may be obtained, in another embodiment, the value of each pixel and of its adjacent pixels is monitored and a maximum value is allocated thereto if the value of all the pixels exceeds a threshold value.

Thus, for example, referring to FIG. 8, the four pixels neighboring a pixel undergoing processing which are assigned a coefficient "2" are considered. This therefore involves considering the left, right pixels and the pixels situated at the top and at the bottom. If the five pixels all have an initial value greater than the threshold value, then the maximum value "0xFC" is assigned to the pixel undergoing processing.

The threshold value is for example equal to "0xF8", this conveying that the five coding bits of the red or blue component are set to "1".

The maximum value assigned to the pixel processed corresponds to a value according to which the six coding bits are set to "1".

It will however be noted that according to the present description, the addition of a further bit for coding a red or blue component includes setting the third bit of the coding word, considered starting from the least significant bit, to "0" or to "1".

It is also possible, as a variant, to set the third bit, considered starting from the most significant bit, to "1" or "0".

In this case, the threshold value with which the value of a pixel undergoing processing and the value of the four adjacent pixels are compared becomes "0x1F", whereas the maximum value assigned to the pixel analysed becomes "0x3F".

In this case, the algorithm used in the application of the conversion process from a 16 bpp image into an 18 bpp image may be carried out by using the following lines of code:

```
for (i=0 ; i<Height ; i++)
{
    if ((i !=0 && (i !=Height−1)))
        for j=0 ; j<Width*3 ; j=j+3)
        {
          if ((j !=0 && (j !=Width*3−3)))
          {
// Red Processing
// Compute Delta between Red and Green Value for the 9
pixels
Delta[0]=Buffer1[((i−1)*Width*3)+j−3]−Buffer1[((i−
1)*Width*3)+j−2]
Delta[1]=Buffer1[((i−1)*Width*3)+j]−Buffer1[((i−
1)*Width*3)+j−1]
Delta[2]=Buffer1[((i−1)*Width*3)+j+3]−Buffer1[((i−
1)*Width*3)+j+4]
Delta[3]=Buffer1[(i*Width*3)+j−3]−Buffer1[(i*Width*3)+j−
2]
Delta[4]=Buffer1[(i*Width*3)+j]−Buffer1[(i*Width*3)+j+1]
Delta[5]=Buffer1[(i*Width*3)+j+3]−
Buffer1[(i*Width*3)+j+4]
Delta[6]=Buffer1[((i+1)*Width*3)+j−3]−
Buffer1[((i+1)*Width*3)+j−2]
Delta[7]=Buffer1[((i+1)*Width*3)+j]−
Buffer1[((i+1)*Width*3)+j+1]
Delta[8]=Buffer1[((i+1)*Width*3)+j+3]−
Buffer1[((i+1)*Width*3)+j+4]
Filtered__Delta=(Delta[0]+2*Delta[1]+Delta[2]+2*Delta[3]+4
*Delta[4]+2*Delta [5]+Delta[6]+2*Delta[7]+Delta[8]/16
Current__Red=Buffer1[(i*Width*3)+j]
Current__Green=Buffer1[i*Width*3)+j+1]
if ((Filtered__Delta−Delta[4]>2)
  Current__Red=Current__Red+4
Else if ((Filtered__Delta−Delta[4])<=−2)
{
  If (Current__Red !=0)
      Current__Red=Current__Red−4
}
if ((((Buffer1[((i−1)*Width*3)+j]) & 0xF8)      == 0xF8) &&
  ((Buffer1[(i*Width*3)+j−3]) & 0xF8)      == 0xF8) &&
  (((Buffer1[i*Width*3)+j]) & 0xF8)      == 0xF8) &&
  (((Buffer1[i*Width*3)+j+3] & 0xF8)      == 0xF8) &&
  (((Buffer1[((i+1)*Width*3)+j]) & 0xF8)      == 0xF8))
  Current Red = 0xFC;
      Buffer2[(i*Width*3)+j=Current__Red
}
else
{
      Buffer2[(i*Width*3)+j= Buffer1[(i*Width*3)+j]
    }
  }
}
else
{
  for(j=0 ; j<Width*3 ; j=j+3)
  {
      Buffer2[(i*Width*3)+j= Buffer1[(i*Width*3)+j]
      Buffer2[(i*Width*3)+j+1]=
Buffer1[(i*Width*3)+j+1]
      Buffer2[(i*Width*3)+j+2]=
Buffer1[(i*Width*3)+j+2]
```

-continued

```
        }
    }
  }
```

That which is claimed is:

1. An image processing method for conversion, within an electronic device, of an image with a first number of bits per pixel into an image with a second number of bits per pixel greater than the first number of bits per pixel, the signal to be converted and the converted signal respectively comprising a set of pixels each associated with red, green and blue component values forming a frame with the first number of pixels and a frame with the second number of pixels, the method comprising:

generating additional bit values, via an image processing device of the electronic device, for coding component values of each pixel starting from component values of adjacent pixels; and using the additional bit values for generating the converted signal with the image processing device.

2. A method according to claim 1, wherein the image to be converted and the converted image respectively comprise a set of pixels associated with red, green and blue component values forming a frame with 16 bits per pixel and a frame with 18 bits per pixel, respectively.

3. A method according to claim 1, wherein the image to be converted comprises a matrix of rows and columns of pixels; and wherein values of the additional bits are generated by considering pixels from an analysis window of 3×3 pixels.

4. A method according to claim 1, wherein the image to be converted comprises a matrix of rows and columns of pixels; and wherein values of the additional bits are generated by considering the pixels from an analysis window of 5×5 pixels.

5. A method according to claim 1, wherein the values of the coding bits of the green component of the image to be converted are assigned to the bits of the green component of the converted image.

6. A method according to claim 5, wherein the values of the additional coding bits of the red component and of the blue component are determined by calculation, for each of the red and blue components, of a difference between the values of the red and green components, and of the difference between the values of the blue and green components, by calculation of a filtered value from the calculated difference values and by assigning one additional bit to the values of the red and blue components of the image to be converted as a function of the filtered value.

7. A method according to claim 6, wherein the filtering is effected by applying weighting coefficients to the calculated difference values.

8. A method according to claim 7, wherein the weighted values are added and the result of the addition is divided by a sum of the weighting coefficients from an analysis window.

9. A method according to claim 8, wherein if the difference between the filtered value of the red component, and of the blue component, and the non-filtered values of the components, respectively, is greater than 2, the additional bit is set at 1.

10. A method according to claim 9, wherein if the difference between the filtered value of the red component, and of the blue component, and the non-filtered values of the components, respectively, is less than or equal to −2, the additional bit is obtained by subtracting a bit 1 at the location of the additional bit.

11. A method according to claim 10, wherein if the difference is less than or equal to 2 or greater than −2, the additional bit is set at 0.

12. A method according to claim 11, wherein the value of a pixel undergoing processing and of adjacent pixels is compared with a threshold value and a maximum value is assigned to the pixel undergoing processing if this pixel and the adjacent pixels all have a value greater than the threshold value.

13. An electronic device comprising:

a frame memory; and an image processing device cooperating with said frame memory for conversion of a signal with a first number of bits per pixel into a signal with a second number of bits per pixel greater than the first number of bits per pixel, the signal to be converted and the converted signal comprising a set of pixels each associated with red, green and blue component values forming a frame with the first number of bits and a frame with the second number of bits, respectively;

said image processing device generating additional bit values for coding the components of each pixel starting from the component values of adjacent pixels, and generating the converted signal starting from the coding bits for the values of the red, green and blue components of the signal to be converted and from the additional bits.

14. An electronic device according to claim 13, further comprising a display coupled to said image processing device.

15. An electronic device according to claim 14, wherein said display comprises a flat panel screen.

16. An electronic device according to claim 14, further comprising a portable housing carrying said frame memory, said image processing device and said display.

17. An electronic device according to claim 16 further comprising a wireless transceiver carried by said portable housing so that the electronic device comprises a portable wireless telephone.

18. An image processing device for cooperating with a frame memory and a display for conversion of a signal with a first number of bits per pixel into a signal with a second number of bits per pixel greater than the first number of bits per pixel, the signal to be converted and the converted signal comprising a set of pixels each associated with red, green and blue component values forming a frame with the first number of bits and a frame with the second number of bits, respectively, the image processing device comprising:

a circuit for generating additional bit values for coding the components of each pixel starting from the component values of adjacent pixels; and a circuit for generating the converted signal starting from the coding bits for the values of the red, green and blue components of the signal to be converted and from the additional bits.

19. An image processing device according to claim 18, wherein the image to be converted and the converted image respectively comprise a set of pixels associated with red, green and blue component values forming a frame with 16 bits per pixel and a frame with 18 bits per pixel, respectively.

20. An image processing device according to claim 18, wherein the image to be converted comprises a matrix of rows and columns of pixels; and wherein values of the additional bits are generated by considering pixels from an analysis window of pixels.

21. An image processing device according to claim 18, wherein the values of the coding bits of the green component of the image to be converted are assigned to the bits of the green component of the converted image.

22. An image processing device according to claim 21, wherein the values of the additional coding bits of the red component and of the blue component are determined by calculation, for each of the red and blue components, of a difference between the values of the red and green components, and of the difference between the values of the blue and green components, by calculation of a filtered value from the calculated difference values and by assigning one additional bit to the values of the red and blue components of the image to be converted as a function of the filtered value.

* * * * *